US009027498B2

(12) United States Patent
Ophardt

(10) Patent No.: US 9,027,498 B2
(45) Date of Patent: May 12, 2015

(54) BOAT OR SHIP BODY OF ALUMINUM-BASED MATERIAL

(75) Inventor: Hermann Ophardt, Duisburg (DE)

(73) Assignee: OP-Maritim IP GmbH, Niederbipp (CH)

( * ) Notice: Subject to any disclaimer, the term of this patent is extended or adjusted under 35 U.S.C. 154(b) by 157 days.

(21) Appl. No.: 13/603,629

(22) Filed: Sep. 5, 2012

(65) Prior Publication Data

US 2013/0068154 A1 Mar. 21, 2013

(30) Foreign Application Priority Data

Sep. 15, 2011 (DE) ..... 10 2011 114 314

(51) Int. Cl.
*B63B 3/32* (2006.01)
*B63B 3/09* (2006.01)
*B63B 3/04* (2006.01)

(52) U.S. Cl.
CPC .... *B63B 3/09* (2013.01); *B63B 3/04* (2013.01)

(58) Field of Classification Search
USPC ..... 114/355, 356
See application file for complete search history.

(56) References Cited

U.S. PATENT DOCUMENTS 1,923,544 A * 8/1933 Leonard et al. ..... 114/356
4,214,332 A * 7/1980 Stoner ..... 114/356
4,565,146 A 1/1986 Koser et al.
4,917,037 A 4/1990 Hargett, Sr.

FOREIGN PATENT DOCUMENTS

EP 0 049 871 4/1982
FR 2 408 508 6/1979

OTHER PUBLICATIONS http://www.kastenmarine.com/frames_first.htm, printed Aug. 10, 2012, previously accessed before Sep. 15, 2011.
http://www.kastenmarine.com/metalboats.htm, printed Aug. 10, 2012.
http://www.kastenmarine.com/aluminum.htm, printed Aug. 10, 2012.

* cited by examiner

*Primary Examiner* — S. Joseph Morano
*Assistant Examiner* — Andrew Polay
(74) *Attorney, Agent, or Firm* — W. F. Fasse

(57) ABSTRACT

A watercraft body includes a hull made of an aluminum-based material and a separately fabricated superstructure that is mounted on the hull via adjoining flange plates. To fabricate the hull, frame elements are spot-welded onto the inner surface of initially-flat hull plates or plank elements, which are then curved according to the required hull contour and assembled onto the flange plate. The frame elements are screwed together via gusset plates and transverse beams to form transverse frames, and then longitudinal seams between plank elements are continuously welded from the outside. Additionally, the longitudinal seams may be welded from the inside, for example by temporarily removing gusset plates to allow continuous access to the longitudinal seams. Additionally, stand-offs may form a spacing gap between the frame elements and the plank elements, and an adhesive may fill this spacing gap to adhesively bond the framework to the hull plating.

18 Claims, 7 Drawing Sheets

BOAT OR SHIP BODY OF ALUMINUM-BASED MATERIAL

PRIORITY CLAIM

This application is based on and claims the priority under 35 USC 119 of German Patent Application 10 2011 114 314.2, filed on Sep. 15, 2011, the entire disclosure of which is incorporated herein by reference.

FIELD OF THE INVENTION

The present invention relates to a body of a boat or ship including a hull made of metal sheets or plates of an aluminum-based material in the form of planks that provide the outer planking of the hull. The invention relates to watercraft in general, for which the terms boat and ship are used generally and interchangeably, for all sizes, types, applications and configurations of watercraft.

BACKGROUND INFORMATION

It is generally known to fabricate boat or ship bodies with a length from about 8 meters to about 20 meters using glass fiber reinforced plastic materials of various types by various fabrication techniques, including molding techniques, lay-up techniques, and spray-on application for example, in series mass production. On the other hand, hulls for ships or boats of this size category can also be conventionally fabricated using aluminum-based materials, but such metal boat hulls are typically fabricated one-off, i.e. one at a time, and largely by hand using many individual manual operations for assembling and finishing the metal components. Disadvantageously, the manual operations lead to inconsistencies or deviations, and the generally required welding operations can lead to warping and displacement of the components from the required contours and positions. Also, this manner of construction often requires jigs, clamps or fixtures that are temporarily welded onto the hull components for holding the components in place during fabrication, and that are later removed. These factors all give rise to a relatively high degree of required rework, post-work and finishing work to achieve the required finished contours and smooth fair surfaces. Namely, achieving the required hydrodynamic contour and smooth fair surface of such a boat hull of an aluminum-based material often requires considerable expense and effort in the need for grinding off weld beads, temporary weld locations, deformed contours, and the like, and smoothing such areas through the application, shaping and finishing of putty or mastic. In such cases, the thickness of the applied synthetic putty or mastic may actually even exceed the sheet metal thickness of the aluminum-based material of the hull skin or planking. This disadvantageously increases the weight of the hull by the weight of the applied putty or mastic, and also requires significant additional work. Furthermore the applied non-aluminum putty or mastic materials sharply limit the otherwise advantageous recyclability of the aluminum-based material of the hull. Thus, it is desired to provide a hull construction of aluminum-based material that avoids the need for non-metal putty or mastic and especially also avoids warping or deformation of the metal components during the fabrication.

The published French Patent Application having Publication Number FR 2 408 508 discloses a ship or boat body of the general type mentioned above, which has a hull made of several planks of an aluminum alloy that are welded together. For a boat hull length of approximately 10 to 12 meters, the thickness of the aluminum alloy sheets to be used for manufacturing this hull is at least 12 mm and is particularly selected so that the hull is structurally strong and form-stable without any transverse frame or rib elements, and can be used as such. However, there is a substantial weight disadvantage that results due to the significant thickness that is required of the aluminum alloy planks in such a manner of construction. Furthermore, the fabrication process is complicated because special forms or jigs as well as special welding devices are necessary for holding and clamping or tacking the planks in the required position while the welding is carried out.

Additionally, the published European Patent Application having Publication Number EP 0 049 871 discloses a boat hull that is assembled from plank-like aluminum profiles, which are pre-bent or pre-curved corresponding to the desired hull shape, and then the planks are joined with one another. Particularly, the individual planks have shank-like or flange-like projections that extend in the boat's longitudinal direction along the edges of the planks and that are screwed together with one another in order to connect adjacent planks.

Furthermore, U.S. Pat. No. 4,917,037 discloses a boat or ship body with a hull of metal, particularly aluminum, and an inner or upper structure of fiberglass. The fiberglass inner structure is set into and joined to the aluminum hull structure along an exterior perimeter edge of the hull forming a gunwale. The hull has a typical conventional kinked rib or bent rib cross-section, with a chine-like intermediate portion between the sidewall portion and the bottom portion of the hull. In addition to the outer skin, the hull further includes regularly spaced transverse frames or ribs as well as longitudinally extending stiffening beams or stringers. Particular construction details of the aluminum hull and its assembly are not disclosed.

The internet webpage http://www.kastenmarine.com/frames_first.htm includes a discussion of various different methods for fabricating boat hulls of aluminum. Particularly, that webpage discloses a fabrication method called the "plate-first" method, which uses a 3D-CAD model, by which the metal plates that form individual plank elements are pre-cut corresponding to their respective desired perimeter configuration or developed plan form, and then so arranged that they are anchored one after another on specialized jigs or holding devices in the respective proper positions, where they are clamped or tacked and finally welded together with one another. According to the method described in this internet webpage, this process can be carried out without the use of a transverse rib framework. Instead, in such a known manner of assembling a boat hull, the transverse rib framework is only later inserted into and welded onto the hull planking or skin that has first been fabricated by itself as discussed above. A significant advantage of such a construction technique is that it can largely avoid the above mentioned undesirable deformations of the aluminum outer skin of the hull, which can otherwise arise when aluminum plank elements are welded to the respective allocated transverse ribs.

Furthermore, the above mentioned internet webpage http://www.kastenmarine.com/frames_first.htm, with regard to so-called single-chine hull shapes, mentions the advantage that the sheet metal plates used as plank elements for constructing such boat hulls do not need to be rolled or otherwise deformed before the assembly or construction of the hull. This article also mentions that it is possible to weld the rib or frame elements onto the plank elements before the assembly thereof.

All of the above discussed known fabrication methods require various auxiliary structures and devices, on the inside and/or on the outside of the hull, in order to carefully and sufficiently hold or tack the planking plates in place for then carrying out the welding. It would be desirable to reduce or eliminate the need for such auxiliary structures, holding devices, jigs, clamps, and other fabrication accessories, so as to simplify the fabrication process and thereby reduce the costs.

SUMMARY OF THE INVENTION

In view of the above, it is an object of the present invention to further develop a body construction for a ship or boat of the above mentioned general type, in such a manner that it can be fabricated in a simple and reliable manner using pre-fabricated elements as a building block system. A further object of the invention is to improve the fabrication process so as to minimize or avoid the need for jigs, clamps or other holding fixtures during the fabrication process, while still minimizing or avoiding the undesirable warping or other deformation of the metal hull plating during the welding and other fabrication steps. The invention further aims to avoid or overcome the disadvantages of the prior art, and to achieve additional advantages, as apparent from the present specification. The attainment of these objects is, however, not a required limitation of the claimed invention.

The above objects have been achieved according to the invention, wherein a watercraft body (e.g. a body for a ship or boat) comprises a hull made with aluminum-based material components and a superstructure (e.g. a topside structure or upper structure or any structure above the hull) that is fabricated as a separate unit and is then secured onto the hull by means of adjoining flange plates that are respectively provided both along an upper perimeter edge of the hull and a lower perimeter edge of the superstructure. In a preferred embodiment of the invention, the perimeter junction between the two flange plates extends parallel to the waterline or water plane, and is preferably located at an optimal height above the waterline to simultaneously serve as a structural support and carrier for a lateral fender profile member around the perimeter of the watercraft body. In this manner, the invention makes it possible to produce different watercraft bodies for various different applications, without requiring many special alterations, in that the same standardized hull of aluminum-based material can be combined with any desired one of different superstructures respectively having different forms, layouts, materials, etc. The different superstructures respectively all have the same identical flange plates as a basis, to ensure that any one of the different superstructures can be mounted on the same standardized hull.

According to further aspects of the invention, special structural arrangements and construction techniques of the hull itself are provided, so that the invention is also directed to such aspects of the hull itself, without regard to an optional final fitment with a superstructure.

For example, in an advantageous further embodiment of the invention, the fabrication and resulting structure of the hull is preferably as follows. Upper plank elements that will form side plates of the hull are first provided with rib or frame elements mounted on an inner side thereof, and these upper plank elements are then fixed to the flange plate that gives the plan form to the hull and forms the upper boundary of the hull. Lower plank elements that will form the bottom plates of the hull are provided with frame elements mounted on the inner surface thereof and are then joined to the upper plank elements, preferably by continuous welding to form a continuous longitudinal weld joint along the longitudinal seams between the adjacent upper and lower plank elements. Then the rib or frame elements on the inner surface of the hull plating are connected respectively with one another in the transverse direction, relative to the hull longitudinal axis, by respective allocated gusset plates as well as floor cross beams. The frame elements, gusset plates and floor cross beams are connected with one another by removable fasteners such as screws, bolts, clips or pins. Preferably, the frame elements are spot-welded onto the inner surface of the plank elements, and are further preferably additionally bonded continuously surfacially onto the inner surface of the plank elements by an adhesive that is injected into a purposeful gap between the facing surfaces of the frame elements and the plank elements.

Before they are mounted on the plank elements, the frame elements are initially fabricated each respectively with an individually hat-shaped profile including a spine or base web, two legs or shanks or side webs protruding at an angle from the two opposite edges of the spine or base web, and two contact flanges or mounting flanges respectively protruding at an angle from the distal or free edges of the two legs or shanks. The two contact or mounting flanges preferably include welding tabs that preferably have a slotted opening therein, at which the mounting flanges are spot-welded onto the inner surface of the plank elements. In the initial configuration, the individual hat-shaped profiles do not necessarily have perpendicular angles. Instead, the hat-shaped profiles are individually configured appropriately so that the bending of the respective plank element into the curved hull configuration during the fabrication process will result in the final required configuration, spacing and orientation of the frame elements. Namely, the plank elements are initially flat planar sheets when the frame elements are spot-welded onto the inner surface thereof. In this initial mounted configuration, the longitudinal spacing between successive frame elements may be irregular, and the orientations of the legs or side shanks of the frame elements may also be irregular. But then when the respective plank element is bent or curved to the appropriate hull contour during the fabrication process, thereby the longitudinal spacing between successive frame elements along the longitudinal axis of the hull is made uniform, and the hat-shaped profiles of the frame elements are bent or deformed along with the plank element so that in the final configuration the legs or side shanks of the frame elements are all aligned perpendicular to the longitudinal axis of the hull. To facilitate the proper placement of the frame elements on the plank elements, the frame elements preferably have index holes that can be aligned with corresponding index marks on the plank element or with an indexing fixture for placement of the frame elements. Thereby it is ensured that the respective frame elements forming one transverse frame structure will all lie precisely on the same transverse cross-sectional plane once the plank elements have been bent or formed into the required hull shape and welded together along the longitudinal seams.

The gusset plates and floor beams, which are fastened together by screws or the like to form the transverse frames, thereby give the hull structure the necessary structural strength and rigidity, and also provide mounting points for the attachment or mounting of further elements onto or into the hull. All of the components (e.g. plank elements, frame elements, etc.) have been pre-fabricated (e.g. designed, cut to shape, etc.) according to the requirements of the original design, for example by numerically controlled design, manufacturing and machining methods, such that the prescribed hull shape as designed will necessarily result once the components are assembled and connected together. The screwed or bolted connection of the frame elements, gusset plates and transverse beams avoids the need for weld-tacking and then weld-joining these components, and also allows a range of fitting adjustment of the components, for example especially allowing the longitudinal weld seams between adjacent plank elements to be adjusted appropriately. For example, the plank elements are assembled and bent or curved into the required configuration, and the frame elements, gusset plates and transverse beams are screwed or bolted together while making the necessary fitting adjustments, and then the longitudinal plank seams can be welded from the outside and from the inside. Because the fabrication of the boat hull according to the invention does not need any additional holding fixtures, clamps or the like on the outside or on the inside of the hull, therefore, the exterior longitudinal weld seams can be welded continuously with a single continuous weld bead joint, for example preferably by a welding robot according to a preprogrammed welding path, without hindrance or interference or interruption thereof by any clamps, holding fixtures or the like. This also minimizes or avoids warping or other undesired deformation during the assembly and welding process. Then the gusset plates bridging across the longitudinal plank seams on the inner side can be temporarily removed to allow continuous access to the longitudinal seams, so that the longitudinal seams can also be welded continuously by a continuous weld bead joint along the inner surface of the plank elements as well. Then the gusset plates are again screwed or bolted into the final assembled position.

After the complete assembly of all components and after completion of all welding operations, preferably the fabrication of the hull according of the invention further includes an adhesive bonding by which the rib framework is joined in a force-transmitting manner onto the inner surface of the previously welded outer skin or plating. For this purpose, the frame elements were preferably held at a defined spacing distance away from the inner surface of the plank elements, to form a defined gap for receiving the injected adhesive. By this adhesive, the outer skin or plating is bonded surfacially with the rib framework while avoiding the introduction of additional stresses and visible warping or deformations on the surface of the hull. The adhesive bonding additionally provides a noise damping and a thermal isolation break between the hull plating and the inner rib framework. This adhesive bonding further helps to prevent the occurrence of gap or crevice corrosion, increases the cyclic loading bending strength of the complete hull structure, and ties together the entire hull structure into a self-supporting section.

BRIEF DESCRIPTION OF THE DRAWINGS

In order that the invention may be clearly understood, it will now be described in connection with example embodiments thereof, with reference to the drawings, wherein.

DETAILED DESCRIPTION OF A PREFERRED EXAMPLE EMBODIMENT AND OF THE BEST MODE OF THE INVENTION

Figure 1:
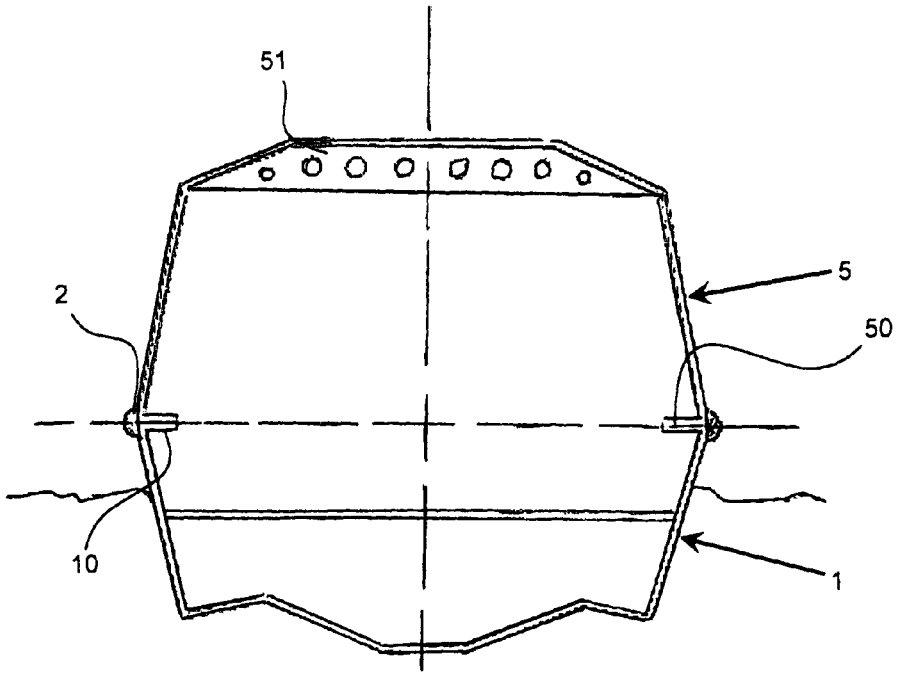
FIG. 1 is a vertical cross-section through a watercraft (e.g. ship or boat) body according to the invention.

As shown in the vertical sectional view of FIG. 1, a watercraft body (e.g. a ship body or boat body) according to the invention includes a bottom hull 1 as well as a superstructure, topside structure or upper structure 5 that is fabricated as a separate unit relative to the hull 1, and is then mounted on and connected to the hull 1. Particularly, the hull 1 and the superstructure 5 are connected to one another by a flange connection of two identical flange plates 10 and 50 that are connected together, for example by screwing, bolting, pinning, riveting, welding, and/or adhesive bonding. The perimeter flange plate 10 is a component of the hull 1, and the perimeter flange plate 50 is a component of the superstructure 5. These flange plates 10 and 50 serve as a shape-defining element for the hull 1 or for the superstructure 5 respectively during the fabrication of those structures. Furthermore, after the flange plates 10 and 50 are joined together, they also form a reinforced perimeter rim of the watercraft body for receiving and carrying a circumferential fender profile member 2. Furthermore, FIG. 1 additionally shows one of the transverse frames or ribs 51 of the superstructure 5. The superstructure 5 may be fabricated from any desired material, such as aluminum-based metals, other metals, fiberglass or other fiber reinforced plastic composite materials, or combinations of materials. The hull 1 is preferably fabricated from aluminum-based materials, such as aluminum alloy sheet metal, particularly a seawater resistant aluminum alloy, such as preferably the aluminum alloy EN AW 5083 (AlMg4, 5Mn, designated as aluminum alloy material number 3.3547). For example, the planking or plating of the hull 1 may be made of sheets or plates or planks of this alloy with a wall thickness of 8 mm, for example, for a typical boat length in the range of 8 m to 20 m, or for example especially 10 to 12 m. While aluminum alloy is a preferred material, and the above mentioned specific alloy is particularly preferred, the inventive structures and methods also apply to, and can be carried out with, any other metal material and/or combinations of different metal materials for different components.

Figure 2:
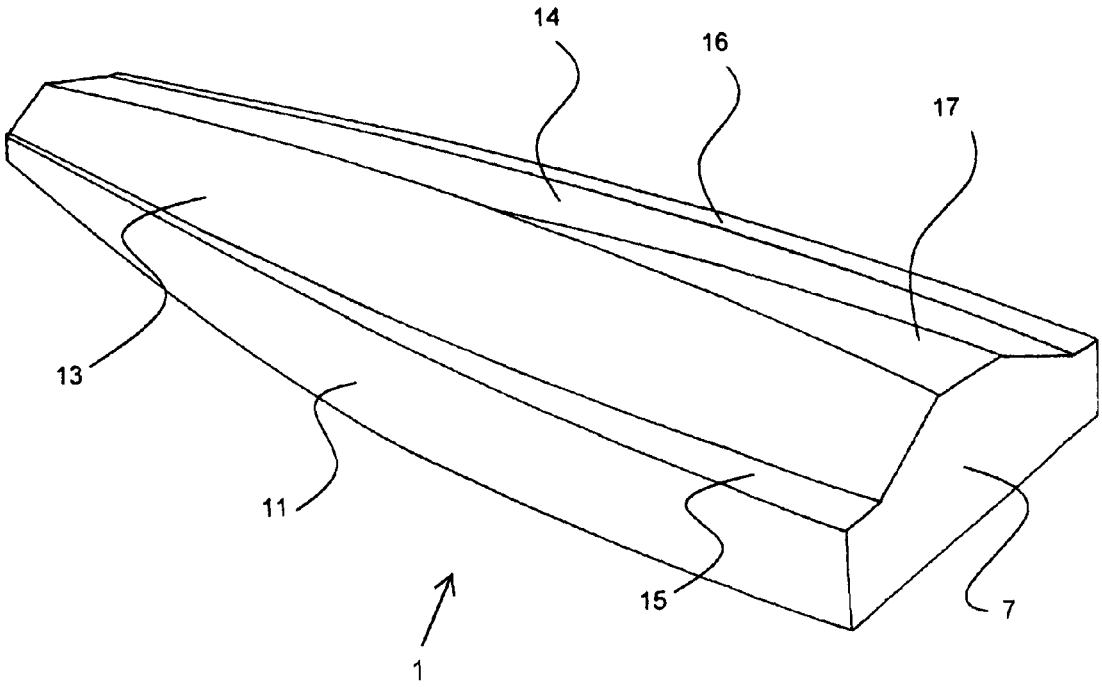
FIG. 2 is a perspective view of the bottom of a hull according to the invention.
Figure 3:
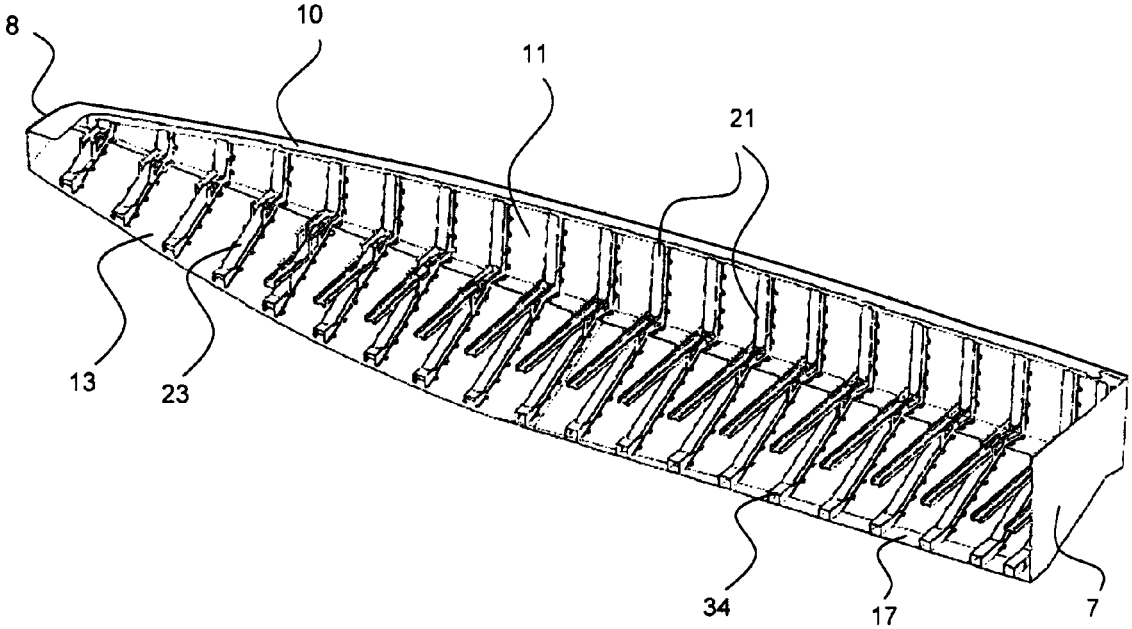
FIG. 3 is a longitudinally vertically sectioned perspective view from the top of the boat hull according to FIG. 2.
Figure 8:
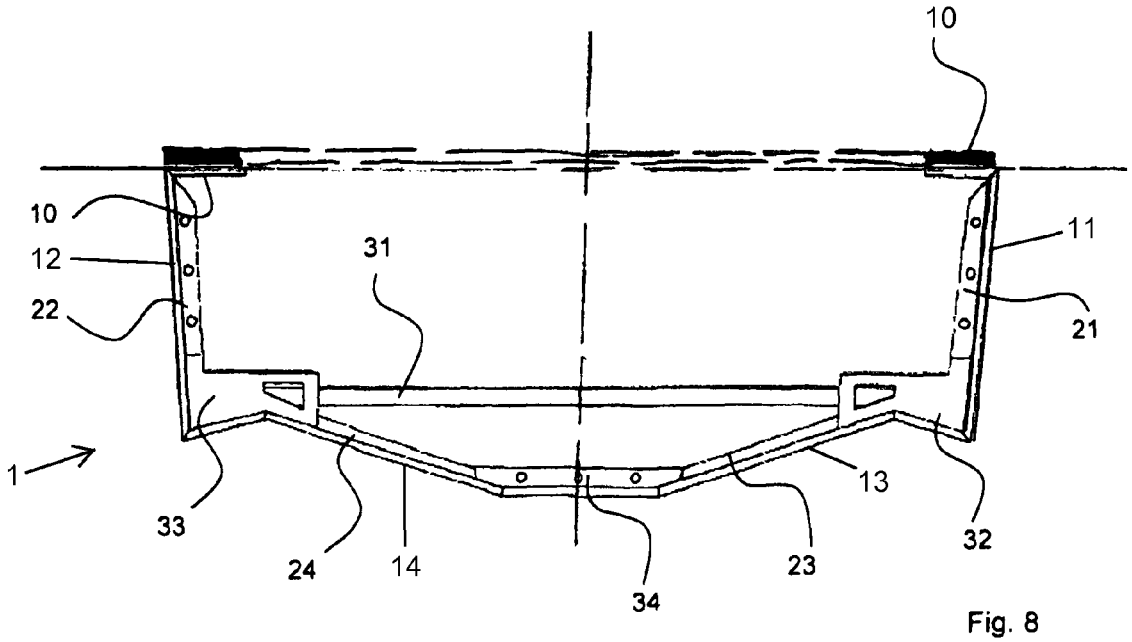
FIG. 8 is a vertical sectional view of the frame construction of the arrangement according to FIGS. 3 to 7.

The structural details and construction of the hull 1 will be explained further with reference to the following figures. As can be seen especially in the perspective view of FIG. 2 and the vertical sectional view of FIG. 8, the hull 1 of the watercraft body includes an outer skin or plating of side plates 11 and 12, bottom plates 13 and 14, chine plates 15 and 16 respectively arranged between a side plate and a bottom plate to form a chine of the hull configuration, a keel plate 17 extending longitudinally along the bottom center of at least an aft portion of the hull 1, and a transom or stern plate 7 closing the aft end of the hull 1. Additionally, as shown in FIG. 3, the hull 1 further includes a bow plate 8 closing the forward end of the hull. These individual plates or plank elements are initially cut with the respective appropriate plan perimeter shape from a flat plate or sheet of the selected aluminum alloy material. The plank elements are then curved or bent during the assembly and fabrication process to achieve the final designed hull contours of the hull 1. Furthermore, defining the outer perimeter contour of the hull, the hull 1 additionally includes a flange plate 10 extending circumferentially around the upper perimeter rim of the hull plating, for example as shown in FIGS. 1, 3 and 8. The flange plate 10 in the present example embodiment is connected to the upper side plates 11 and 12 by a continuous circumferential weld joint.

The sectional illustration of FIG. 3 especially further shows that the hull 1 includes a framework of rib or frame elements arranged in the interior of the outer skin or plating, so as to stiffen and strengthen the overall hull structure. The framework includes first rib or frame elements 21 and 22 arranged and mounted on the side plates 11 and 12, as well as second frame elements 23 and 24 arranged and mounted on the bottom plates 13 and 14. The frame elements 21 to 24 each respectively have a cross-sectional shape of an individually bent hat-shaped profile, as this is especially apparent from FIGS. 3 to 6.

Figure 4:
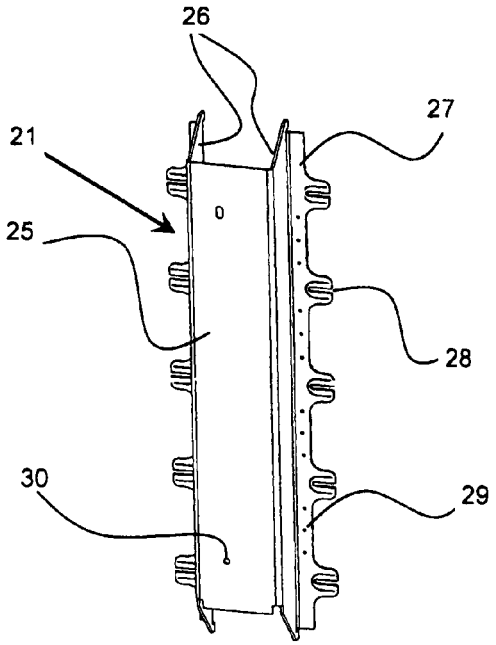
FIG. 4 is a perspective view of a single frame element of the hull according to the invention.

Particularly, the perspective view of FIG. 4 shows an individual frame element 21, from which the hat-shaped profile is apparent, including a spine or base web 25, two legs or shanks or side webs 26 protruding at an angle from the edges of the spine or base web 25, and two mounting flanges 27 respectively protruding from the free or distal edges of the side webs 26. Additionally, slotted weld tabs 28 protrude from the mounting flanges 27, and are each preferably provided with an open-ended slotted hole in which a spot-weld joint 41 (see FIG. 10) to the respective plating plank element may be formed. As will be explained further in connection with FIG. 10 below, each slotted weld tab 28 is further bent along the bounding edges of the slotted hole to form stand-off projections 39 that space the mounting flanges 27 away from the adjacent plank element so as to form a gap 38 between the respective frame element and plate or plank element. Instead of the open-ended slot, the tab 28 can have a round hole, an elongated hole, or a hole of a different shape. As also apparent in FIGS. 4 and 10, a plurality of adhesive injection holes 29 are provided in the mounting flanges 27 of each frame element 21, through which holes 29 an adhesive may be injected at a later time to achieve a force-transmitting surfacial adhesive bond between the frame element and the plank element as will be explained below in connection with FIG. 10.

FIG. 4 further shows a plurality, for example a row, of index holes 30 provided in the spine or base web 25 of the frame element 21. The proper positioning of the frame element 21 on the side plate 11 before attachment thereof is facilitated by these index holes 30, which can be aligned with index marks on the side plate 11, or can be engaged by properly positioned indexing prongs of a temporary indexing jig for placing the frame element into the proper position on the plank element. The index holes 30 are preferably located so that they define the proper position of the respective frame element on the respective plank element when it is still in its undeveloped flat planar configuration. Once the frame element has been properly positioned, then it is attached, e.g. spot-welded, onto the respective flat planar plank element. Later, the plank element will be bent or curved into the final hull contour configuration as the plank elements are assembled to form the hull skin.

Figure 5:
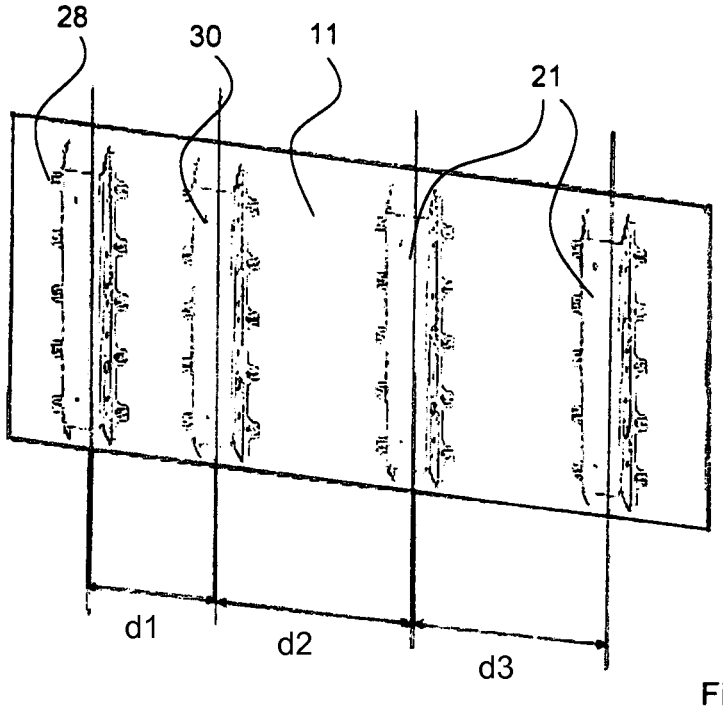
FIG. 5 is a perspective view of a portion of a single plank element of the boat hull according to the invention, in an initial flat planar configuration, with several frame elements mounted thereon.
Figure 6:
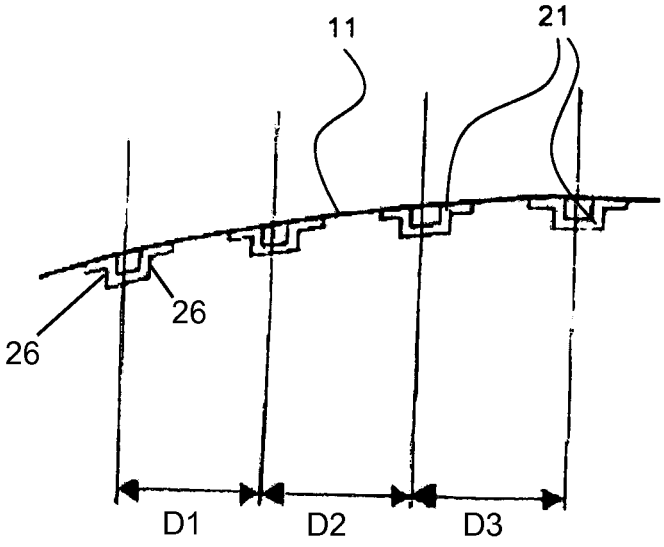
FIG. 6 is a top sectional view of the plank element of FIG. 5, but after the plank element has been bent or curved into the required hull shape.

FIG. 5 shows several first frame elements 21 spot-welded onto an inner surface of a side plate 11, while the side plate 11 is still in its initial flat planar shape. In this initial condition, as can be seen in FIG. 5, the spacing distances d1, d2 and d3 between successive frame elements 21 is not necessarily equal or consistent, namely the distances d1, d2 and d3 are different from one another. Also, the angles at which the shanks or legs 26 of the frame elements are bent relative to the spine or base web 25 may differ from one another. However, during the mounting and fabrication process of the hull 1, the side plate 11 is bent or curved, for example to match the curved contour of the flange plate 10, and is then welded in place onto the flange plate 10. Thereby, the side plate 11 takes on the curved contour as shown in FIG. 6. In this final curved configuration, the longitudinal spacing distances D1, D2 and D3 between successive frame elements 21, in the longitudinal axial direction along the longitudinal axis of the hull 1, are equal to one another as shown in FIG. 6. The initial spacings d1, d2 and d3 as shown in FIG. 5 for the initial flat planar configuration are appropriately selected to result in the consistent final longitudinal spacing distances D1=D2=D3 as shown in FIG. 6. Similarly, as represented in FIG. 6 in the final condition, the shanks or side webs 26 of the frame elements 21 all extend perpendicularly to the longitudinal axis of the hull 1. The initial angled shape of the shanks or side webs 26 of the frame elements 21 in the flat planar condition of FIG. 5 is selected to achieve the orientation of all of the legs 26 perpendicular to the longitudinal hull axis after the side plate 11 has been bent into the final configuration as shown in FIG. 6. It should be understood that the further frame elements 22 to 24 have an analogous structure and assembly, and are also allocated to the plank elements or plates 12 to 14 in an analogous manner, like the above description of the frame elements 21 on the side plate 11.

Figure 7:
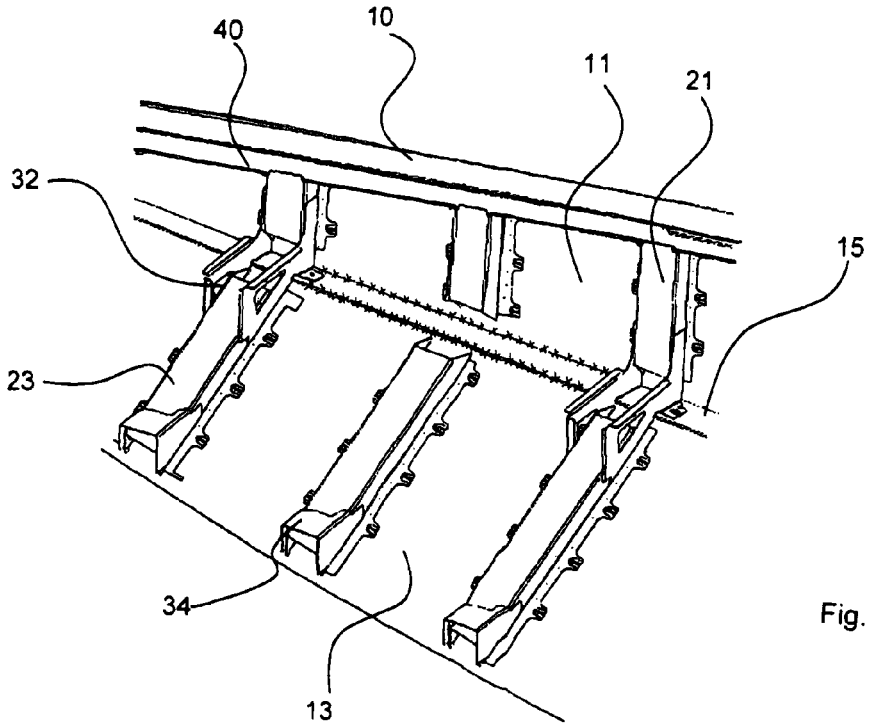
FIG. 7 is an enlarged perspective view of a portion of the hull as shown in FIG. 3, particularly showing the temporary removal of a gusset plate to allow continuous welding of the longitudinal weld joints between adjoining plank elements on the inner side of the hull.
Figure 9:
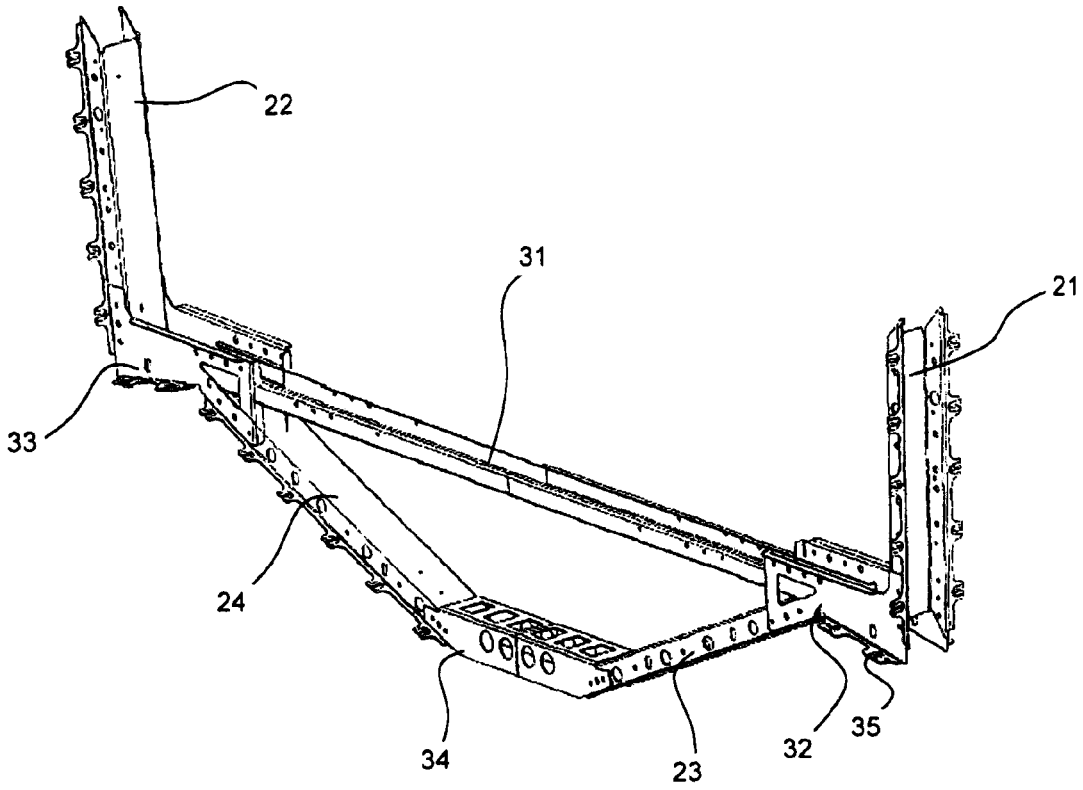
FIG. 9 is a perspective view of a single transverse frame structure according to FIG. 8.

It is further apparent in FIG. 4 that the opposite ends of each frame element 21 are cut-off at a sloping angle. This allows the transversely adjacent frame elements 21 and 23 to be arranged next to one another without overlapping but rather forming an open space between the adjacent ends thereof, as shown in FIG. 7, in the area of the chine step in the hull formed by the chine plate 15 between the side plate 11 and the bottom plate 13. A similar open area is formed between the adjacent ends of the frame elements 23 and 24. As can be seen in FIGS. 7, 8 and 9, the open gaps between the ends of adjacent frame elements are bridged, and the adjacent frame elements are connected to one another, by gusset plates 32, 33 and 34, as well as transverse floor beams 31 Particularly, the lower ends of the frame elements 21 and 22 are connected by the gusset plates 32 and 33 with the upper ends of the frame elements 23 and 24 as well as with the transverse floor beams 31. The lower ends of the frame elements 23 and 24 are connected with one another by the bottom gusset plates 34. The gusset plates are connected to the respective frame elements and the floor beams preferably by screws or bolts in the present illustrated preferred embodiment. In this application, the term screw connection generally refers to a connection using a releasable or removable fastener such as a screw without a nut or a bolt with a nut. A removable fastener includes any fastener that can be removed without being destroyed.

As can be seen in FIG. 9, the gussets plates 32 and 33, similarly like the frame elements 21 to 24, are also provided with mounting flanges with protruding slotted weld tabs 35 having open-ended elongated holes or slots therein, through which spot-weld joints are formed to connect these gusset plates 32 and 33 with the associated chine plates 15 and 16. These spot-welds are formed after the longitudinal seams between the plank elements have been welded on the inside, and the gusset plates have been repositioned and re-fastened with screws.

Figure 10:
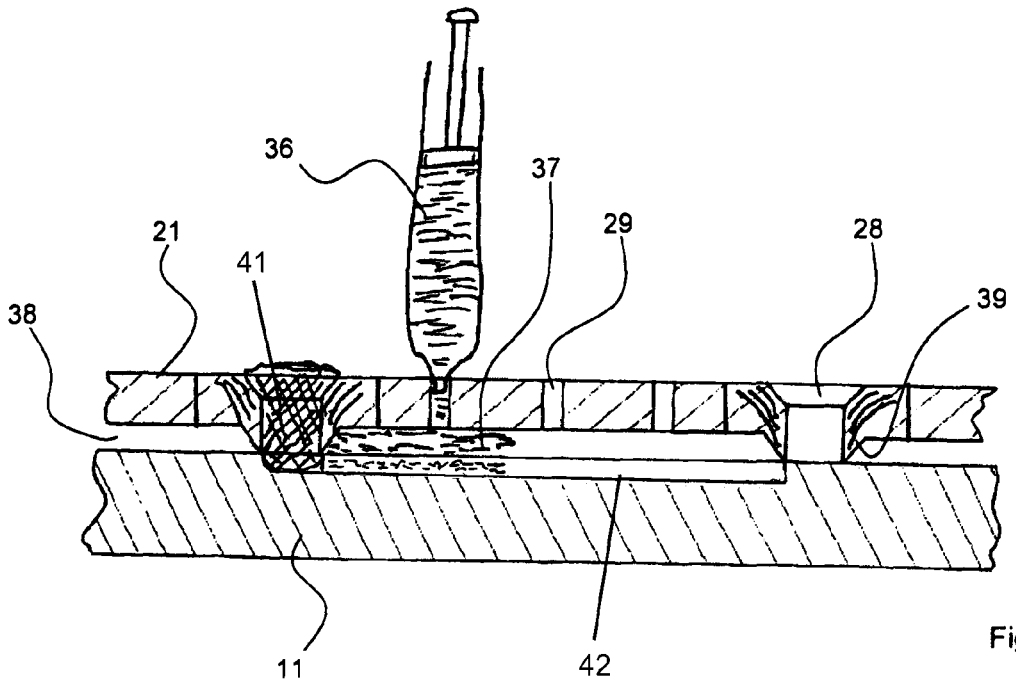
FIG. 10 is a vertical sectional view through a frame element and a plank element, showing the adhesive bonding thereof.
Figure 11:
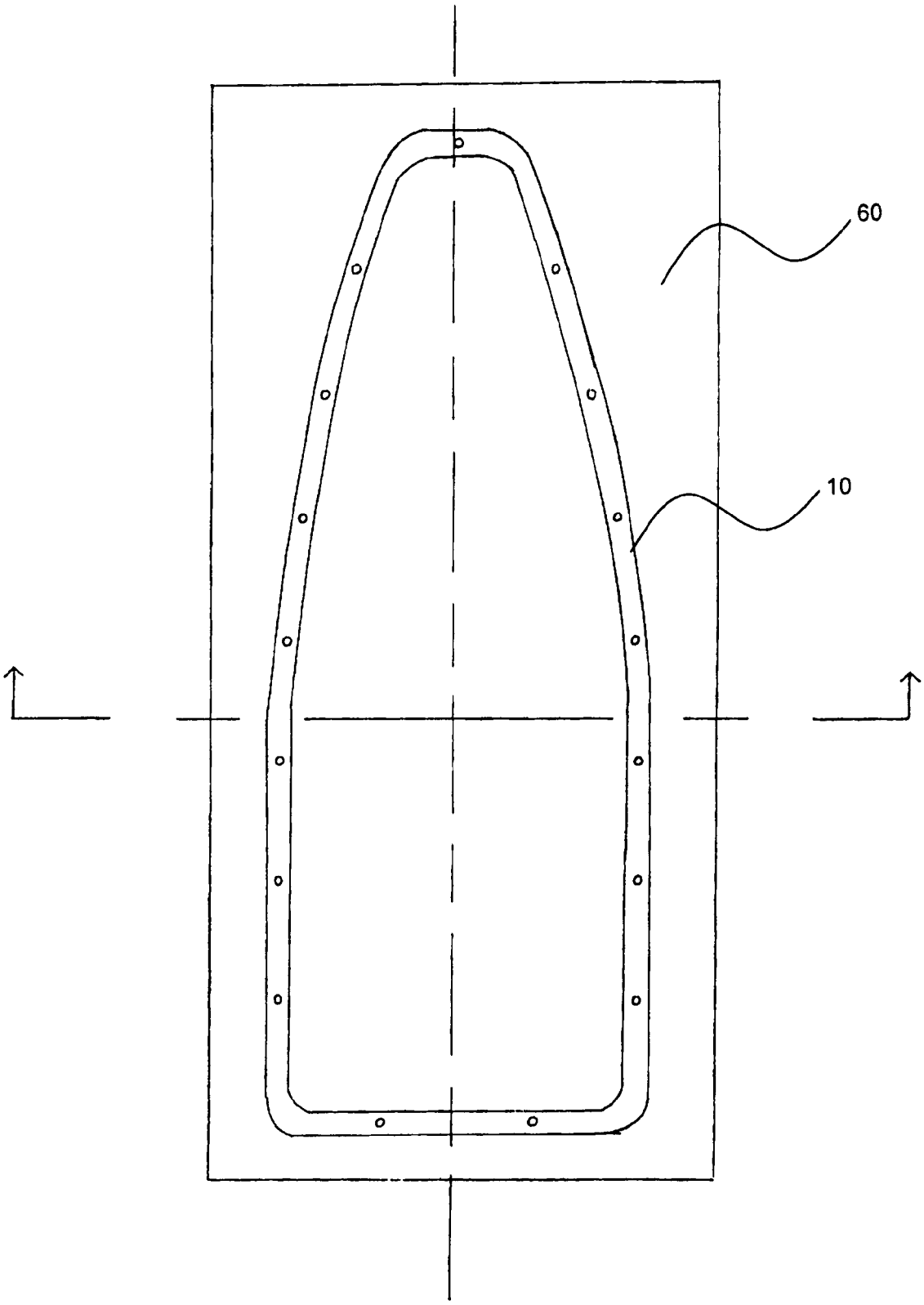
FIG. 11 is a top plan view of a welding table with a flange plate of the hull arranged thereon.
Figure 12:
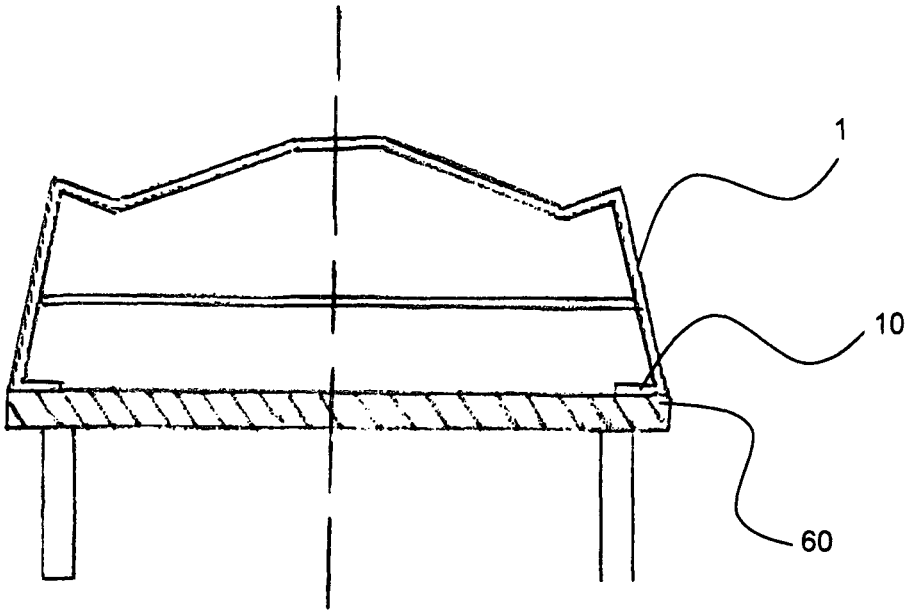
FIG. 12 is a vertical sectional view through the welding table with the boat hull thereon.

A method of fabricating the boat hull 1 according to the invention will now be described, and can be understood in connection with FIGS. 5 to 12. Particularly, the components of the hull 1 as described above are first each separately pre-fabricated, for example the plates or plank elements are all cut from a flat sheet or plate of the selected aluminum alloy material, and the frame elements as well as the gusset plates and transverse beams are cut from such a sheet of material and then bent into the required sectional profile shapes. Next the frame elements are positioned and spot-welded onto the inwardly facing surfaces of the still-flat plates or plank elements as indicated in FIG. 5 and as explained above. Then these components will be assembled in an "upside down" or "keel up" orientation on a welding table 60 as shown in FIGS. 11 and 12. The assembly begins by positioning the flange plate 10 onto the welding table 60 as shown in FIG. 11. Thereby, the plan form of the flange plate 10 will define the curved contour shape of the outer skin or plating of the hull to be assembled thereon, beginning with the side plates 11 and 12 with their associated frame elements 21 and 22 mounted thereon. Namely, the side plates or plank elements 11 and 12 are positioned with their upper edge facing downwardly onto the upside down flange plate 10, while the plank elements are then bent or curved to match the curved contour defined by the flange plate 10. In this position, the side plates 11 and 12 are welded onto the flange plate 10 by a continuous weld bead joint, preferably along the outer side and the inner side of the respective side plate where it adjoins the flange plate. Furthermore, the sloping cut-off ends of the frame elements 21 and 22 are welded at discrete locations, e.g. spot-welded, via a connection plate 40 with the flange plate 10. This can also be seen in FIG. 7. This spot-welding of the connection plate 40 can be carried out at the present stage or later during the process when other welding steps are carried out inside the hull as will be described below.

Next, the chine plates 15 and 16 and then the bottom plates 13 and 14 are assembled successively longitudinally adjoining onto the bottom (now upwardly facing) edge of the side plates 11 and 12. The structure is held together in the appropriate position to form the appropriate outer contour of the hull, in that the gusset plates 32, 33 and 34 as well as the transverse beams 31 are installed and screw-connected in order to tie together the respective adjacent frame elements, for example as represented in FIGS. 8 and 9. Thereby, the framework of frame elements is established and provides the necessary strength and rigidity for the structure, so as to hold the plank elements in place in the proper positions with the proper curvature for the hull contour as designed. Thereby, the screw (or bolt) connections allow the necessary range of adjustability and can also be disassembled and reassembled as needed. Thereby also, the need for other clamps, holding fixtures, jigs or tack-welds is avoided, and the assembled frame structure achieves an exact adjustment and secure holding of the plank elements with the appropriate weld seam gaps. At this point, the weld seam gaps, i.e. the longitudinal seams between adjacent plates or plank elements of the hull plating, are each welded with a continuous weld bead joint from the outside of the hull in a single continuous welding pass, for example along pre-programmed weld paths by a welding robot, without any interference or hindrance because no external clamps or holding fixtures are needed. Because the plates or plank elements are supported by the assembled framework while carrying out the welding, this also avoids or minimizes warping of the plank elements during the welding.

As mentioned above, the side plates 11 and 12 are also continuously welded onto the flange plate 10, both from the outside and the inside, by a continuous weld bead, either initially at the start of the process as mentioned above, or at this later stage when also welding the remaining longitudinal seams or joints between successive plank elements. Similarly, the ends of the frame elements 21 and 22 can be welded via the connection plate 40 to the flange plate 10 if that was not already done earlier in the process as mentioned above.

Thereby, a closed water-tight hull skin has been established, which is supported by the framework within. Next, welding and adhesive bonding will be carried out from the inside of the hull, as follows. Because the exterior longitudinal weld joints already adequately hold together the plank elements, it is now possible to again temporarily remove the gusset plates 32, 33 and 34 by simply removing the screw fasteners. This provides a continuous uninterrupted access to the longitudinal seams from the inner side, for example as represented in FIG. 7, where one of the gusset plates 32 has been removed. Next, continuous weld beads are formed along the longitudinal seams from the inside, as represented by X-lines in FIG. 7. However, the continuous weld joints on the inner side of the longitudinal seams are preferably produced step-wise in that only one gusset plate is removed at a time while the welding is performed in that area, as represented in FIG. 7. Thereby it is ensured that the structural strength and rigidity of the whole structure supported by the framework is not compromised during the interior welding process. Alternatively, several or all of the gusset plates can be removed at once if the strength of the structure is not excessively compromised thereby. Thereafter, the gusset plates 32, 33 and 34 are reinstalled by again securing the screw fasteners. At this time, if not yet performed previously, the ends of the frame elements 21 and 22 can be welded via the connection plates 40 to the flange plate 10.

In an alternative embodiment, it is possible to produce adequate weld joints along the longitudinal seams without removing the gusset plates as described above. However, when the gusset plates remain in place, the welding is interrupted and it is difficult or impossible to form a continuous weld bead joint from the inside along the longitudinal seam. Therefore, the above described procedure is preferred, so that a continuous weld bead joint (extending continuously across an area of intersection with the transverse frame) can be established both along the outside and along the inside of each longitudinal seam.

Once the final assembled structure has been established as described above, then the gusset plates, transverse beams and frame elements are preferably additionally welded to each other to form a strong, permanently-joined, fixed framework. Additional longitudinal stringers can be provided if necessary, but are preferably omitted as unnecessary.

As another preferred step to further improve the strength and the load capacity of the resulting boat hull, the frame elements 21 to 24 are finally additionally adhesively bonded to the plank elements 11 to 14. As explained above, the slotted weld tabs 28 on the mounting flanges 27 of the frame elements 21 to 24 each include standoff projections 39 so as to form a defined spacing gap 38 between the frame elements and the plank elements, which are connected together by spot welds 41 on the weld tabs 28. The adhesive injection holes 29 provided in the frame elements communicate into this spacing gap 38. Preferably, adhesive channels 42 are additionally milled into the inner surface of the plates or plank elements 11 to 14 in registration under the injection holes 29 of the frame elements. Thus, as shown in FIG. 10, the adhesive channel 42 and the spacing gap 38 form a space into which an adhesive 37 can be injected. For example, the gap 38 or the space formed by the gap 38 and the channel 42 has a thickness of about 1 mm in a particular embodiment. Thus, after all components have been completely assembled as described above, and all welding steps have been completed, then the adhesive bonding process is performed by injecting a dosed quantity of the adhesive 37 from a suitable injection syringe 36 (e.g. a caulking gun or the like), through the adhesive injection holes 29 of the frame elements into the spacing gap 38 and adhesive channel 42, so as to flow therealong until the adhesive 37 completely fills this space and begins to extrude visibly out from under the edges of the frame elements 21 to 24. Thereby, a complete, high value and self adapting adhesive bond between the frame elements and the plates or plank elements is ensured. Thereby the outer skin plating is further securely connected to the framework structure over essentially the entire contact surface of the frame elements, without introducing any additional stresses or visible deformations on the outer surface of the hull. The adhesive also seals these joints or gaps and helps to prevent gap or crease corrosion of the metal material.

Figure 13:
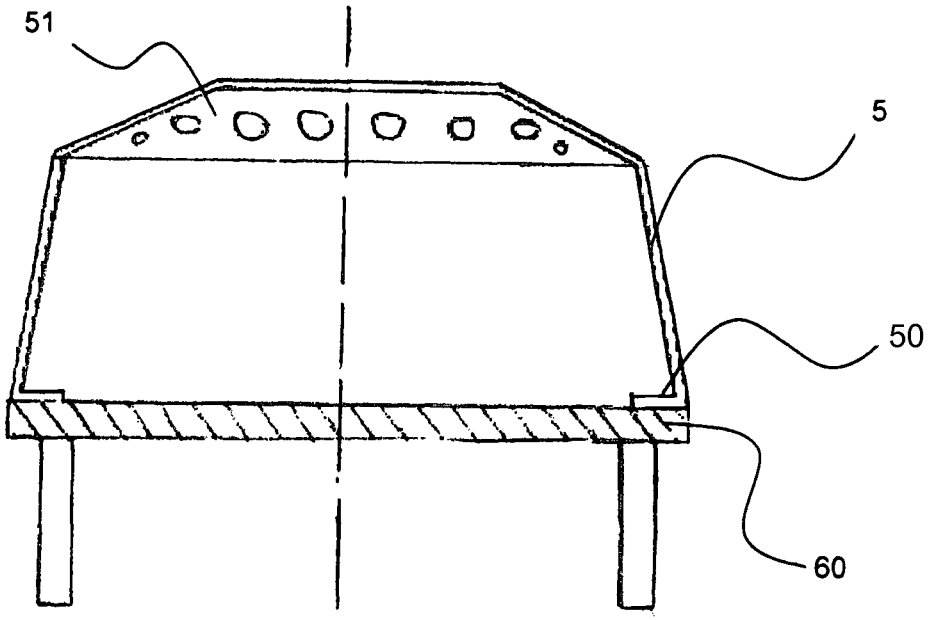
FIG. 13 is a vertical sectional view of the welding table with the boat superstructure thereon.

After the aluminum alloy hull 1 has been completely fabricated with the designed hull contour, with smooth and fair outer surfaces with essentially no deformation, as described above, a separately fabricated topside structure or superstructure 5 can be mounted on and connected with the hull 1 via the adjoining flange plates 10 and 50 as represented in FIG. 1. In this regard, the superstructure 5 is separately fabricated, for example as indicated in FIG. 13, preferably in a similar manner as the fabrication of the hull 1. For example, the flange plate 50 is positioned on the welding table 60, and then plank elements and associated frame elements are assembled and welded together on the flange plate 50. Alternatively, the superstructure 5 can be fabricated by any other known production method using any known materials. Preferably however, the superstructure 5 is also made of the aluminum-based alloy material. Then the superstructure 5 is simply placed on top of the hull 1 such that the flange plates 50 and 10 align on one another, and then these flange plates are connected by welding, screws, bolts, rivets, adhesive bonding, etc. Finally, a fender profile member 2 can be installed over the joined flange plates from the outside.

Preferably, the construction of the watercraft body is carried out with the aid of a 3D-CAD system, which numerically represents and specifies all individual components in their respective final installed positions and also as initial sheet metal blanks in a flat planar form. Because each individual component is numerically represented by all of its dimensions and other characteristics and by its initial layout as well as its final installed position and configuration, therefore all of the individual components and any desired variants thereof establish a digital building block system with high precision. The individual components, i.e. the individual building blocks, can then be selected from among available variants, and manipulated or further designed as a modular system for building watercraft bodies. The cutting, shaping and welding can also be numerically computer controlled and carried out via suitable robots. The screw connections can also be fastened and unfastened by robots. Alternatively or additionally, manual work can be performed as needed by fabrication personnel.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims. The abstract of the disclosure does not define or limit the claimed invention, but rather merely abstracts certain features disclosed in the application.

What is claimed is:

1. A watercraft comprising a hull and a superstructure, wherein:

said hull comprises hull planks of an aluminum-based material, which are welded together by weld joints along longitudinal seams between adjacent ones of said hull planks to form a hull skin of said hull, wherein said hull planks include upper side planks forming sides of said hull skin and bottom planks forming a bottom of said hull skin;

said hull further comprises a first flange plate connected to upper edges of said upper side planks at an upper edge of said hull skin, wherein said first flange plate forms a top perimeter of said hull;

said superstructure includes a second flange plate that forms a bottom perimeter of said superstructure;

said superstructure is connected to said hull by said second flange plate being connected to said first flange plate;

said hull further comprises frame elements connected to inner surfaces of said hull planks;

said hull further comprises gusset plates screwed or bolted to adjacent ones of said frame elements that are adjacent to one another in a transverse direction extending transverse to a longitudinal axis of said watercraft, whereby said gusset plates connect together said adjacent ones of said frame elements;

said hull further comprises transverse floor beams that extend in said transverse direction and that are each screwed or bolted to opposite ones of said gusset plates on opposite sides of said hull in said transverse direction; and said hull includes no longitudinal stringers.

2. The watercraft according to claim 1, wherein said second flange plate has an identical shape as said first flange plate.

3. The watercraft according to claim 1, wherein said hull planks further comprise chine planks interposed between said upper side planks and said bottom planks.

4. The watercraft according to claim 3, wherein at least some of said gusset plates are spot-welded to said chine planks.

5. The watercraft according to claim 1, wherein said hull planks further comprise a keel plank interposed between said bottom planks along a bottom axial centerline of said hull at least in an aft portion of said hull, and wherein at least one of said gusset plates is connected to said keel plank.

6. The watercraft according to claim 1, wherein said frame elements each have a hat-shaped cross-section including mounting flanges extending from side webs, and wherein said frame elements are respectively connected to said hull planks by weld joints on said mounting flanges.

7. The watercraft according to claim 6, wherein said side webs of all of said frame elements each extend perpendicularly to said longitudinal axis of said watercraft at all longitudinal positions of all of said frame elements along a longitudinal length of said hull when said hull is in a final assembled condition, whereby some of said side webs are not perpendicular to said hull skin.

8. The watercraft according to claim 1, wherein said hull further comprises a flat bow plate extending substantially vertically, and a transom plate that are each connected with said first flange plate and with longitudinal ends of said hull planks.

9. The watercraft according to claim 1, wherein said superstructure further includes a superstructure skin which adjoins an outer edge of said second flange plate substantially flush with said hull skin adjoining an outer edge of said first flange plate.

10. The watercraft according to claim 1, wherein:

said frame elements are connected to said inner surfaces of said hull planks by spot welds;

said adjacent ones of said frame elements are not connected directly to one another, and leave respective spaces between one another in said transverse direction, at locations of said longitudinal seams between said adjacent ones of said hull planks; and said gusset plates respectively span said respective spaces between and tie together said adjacent ones of said frame elements.

11. The watercraft according to claim 10, wherein said weld joints include an interior weld joint that comprises a weld bead extending continuously without interruption longitudinally through said respective spaces along one of said longitudinal seams on an interior surface of said hull skin.

12. The watercraft according to claim 1, wherein said weld joints include an exterior weld joint that comprises a continuous uninterrupted weld bead extending longitudinally continuously along an entire longitudinal length of one of said longitudinal seams on an exterior surface of said hull skin.

13. The watercraft according to claim 1, wherein said frame elements are connected to said inner surfaces of said hull planks by an adhesive interposed and forming an adhesive joint respectively between said frame elements and said hull planks.

14. The watercraft according to claim 6, wherein:

said hat-shaped cross-section of each said frame element further includes a back web and slotted spot-welding tabs protruding from edges of said mounting flanges, said side webs protrude from opposite edges of said back web, and said mounting flanges protrude from distal edges of said side webs;

each one of said slotted spot-welding tabs includes an opening selected from a round hole, an elongated hole or an open-ended slot, and includes a stand-off projection that projects away from a plane of said respective mounting flange;

said frame elements are arranged on said hull planks with said stand-off projections contacting said inner surfaces of said hull planks and with said stand-off projections spacing said mounting flanges away from said inner surfaces of said hull planks by spacing gaps therebetween; and said frame elements are connected to said inner surfaces of said hull planks by spot-welds that connect said spot-welding tabs to said hull planks at said openings, and by an adhesive in said spacing gaps that adhesively connects said mounting flanges to said hull planks.

15. The watercraft according to claim 14, wherein said mounting flanges have adhesive injection holes that communicate into said spacing gaps and enable said adhesive to be injected through said holes into said spacing gaps, and wherein said holes have said adhesive therein.

16. The watercraft according to claim 14, wherein said hull planks have adhesive flow channels recessed into said inner surfaces thereof adjoining said spacing gaps, and wherein said adhesive flow channels have said adhesive therein.

17. A method of fabricating said watercraft according to claim 14, comprising steps:

a) providing one of said hull planks in a flat planar configuration;

b) positioning and spot-welding a plurality of said frame elements onto said hull plank in said flat planar configuration, wherein different longitudinal spacing distances exist between successive adjacent ones of said frame elements along a longitudinal direction of said hull plank in said flat planar configuration, and wherein at least some of said side webs of said frame elements are non-perpendicular relative to a plane of said hull plank in said flat planar configuration; and c) deforming said hull plank from said flat planar configuration to a final curved configuration defined by a required curved contour of said hull, wherein, in said final curved configuration of said hull plank, all of said side webs of said frame elements extend perpendicularly relative to a longitudinal axis of said hull, and said successive adjacent ones of said frame elements are all uniformly spaced by a uniform spacing distance from one another in a longitudinal direction along said longitudinal axis;

whereby said watercraft is fabricated such that:

said hull comprises said hull planks of said aluminum-based material, which are welded together by said weld joints along said longitudinal seams between said adjacent ones of said hull planks to form said hull skin of said hull, wherein said hull planks include said upper side planks forming said sides of said hull skin and said bottom planks forming said bottom of said hull skin;

said hull further comprises said first flange plate connected to said upper edges of said upper side planks at said upper edge of said hull skin, wherein said first flange plate forms said top perimeter of said hull;

said superstructure includes said second flange plate that forms said bottom perimeter of said superstructure;

said superstructure is connected to said hull by said second flange plate being connected to said first flange plate;

said hull further comprises said frame elements connected to said inner surfaces of said hull planks;

said hull further comprises said gusset plates screwed or bolted to said adjacent ones of said frame elements that are adjacent to one another in said transverse direction extending transverse to said longitudinal axis of said watercraft, whereby said gusset plates connect together said adjacent ones of said frame elements;

said hull further comprises said transverse floor beams that extend in said transverse direction and that are each screwed or bolted to said opposite ones of said gusset plates on said opposite sides of said hull in said transverse direction;

said hull includes no longitudinal stringers;

said frame elements each have said hat-shaped cross-section including said mounting flanges extending from said side webs, and wherein said frame elements are respectively connected to said hull planks by said weld joints on said mounting flanges;

said hat-shaped cross-section of each said frame element further includes said back web and said slotted spot-welding tabs protruding from said edges of said mounting flanges, said side webs protrude from said opposite edges of said back web, and said mounting flanges protrude from said distal edges of said side webs;

each one of said slotted spot-welding tabs includes said opening selected from a round hole, an elongated hole or an open-ended slot, and includes said stand-off projection that projects away from said plane of said respective mounting flange;

said frame elements are arranged on said hull planks with said stand-off projections contacting said inner surfaces of said hull planks and with said stand-off projections spacing said mounting flanges away from said inner surfaces of said hull planks by spacing gaps therebetween; and said frame elements are connected to said inner surfaces of said hull planks by said spot-welds that connect said spot-welding tabs to said hull planks at said openings, and by said adhesive in said spacing gaps that adhesively connects said mounting flanges to said hull planks.

18. A method of fabricating said watercraft according to claim 1, comprising steps:

a) spot-welding said frame elements respectively onto respective ones of said hull planks;

b) after said step a), positioning said frame elements and said hull planks to establish a defined hull contour of said hull skin, and screwing or bolting said gusset plates to said frame elements to maintain said defined hull contour;

c) after said step b), forming at least one of said weld joints to include an exterior weld joint comprising a first weld bead extending longitudinally along one of said longitudinal seams on an exterior surface of said hull skin;

d) after said step c), unscrewing or unbolting and then removing a selected one of said gusset plates;

e) after said step d), forming at least one of said weld joints to include an interior weld joint comprising a second weld bead extending continuously longitudinally along one of said longitudinal seams on an interior surface of said hull skin where said selected gusset plate was removed; and f) after said step e), replacing said selected gusset plate and again screwing or bolting said selected gusset plate to said frame elements;

whereby said watercraft is fabricated such that:

said hull comprises said hull planks of said aluminum-based material, which are welded together by said weld joints along said longitudinal seams between said adjacent ones of said hull planks to form said hull skin of said hull, wherein said hull planks include said upper side planks forming said sides of said hull skin and said bottom planks forming said bottom of said hull skin;

said hull further comprises said first flange plate connected to said upper edges of said upper side planks at said upper edge of said hull skin, wherein said first flange plate forms said top perimeter of said hull;

said superstructure includes said second flange plate that forms said bottom perimeter of said superstructure;

said superstructure is connected to said hull by said second flange plate being connected to said first flange plate;

said hull further comprises said frame elements connected to said inner surfaces of said hull planks;

said hull further comprises said gusset plates screwed or bolted to said adjacent ones of said frame elements that are adjacent to one another in said transverse direction extending transverse to said longitudinal axis of said watercraft, whereby said gusset plates connect together said adjacent ones of said frame elements;

said hull further comprises said transverse floor beams that extend in said transverse direction and that are each screwed or bolted to said opposite ones of said gusset plates on said opposite sides of said hull in said transverse direction; and said hull includes no longitudinal stringers.

* * * * *